US008480417B2

(12) United States Patent
Suemitsu et al.

(10) Patent No.: US 8,480,417 B2
(45) Date of Patent: Jul. 9, 2013

(54) WIRE COVER AND ELECTRICAL CONNECTOR

(75) Inventors: Yoshifumi Suemitsu, Chiba (JP); Ryuichi Komiyama, Tokyo (JP); Kazushige Sakamaki, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/192,112

(22) Filed: Jul. 27, 2011

(65) Prior Publication Data

US 2012/0028487 A1 Feb. 2, 2012

(30) Foreign Application Priority Data

Jul. 28, 2010 (JP) ..... 2010-169550

(51) Int. Cl.
*H01R 13/62* (2006.01)

(52) U.S. Cl.
USPC ..... 439/157

(58) Field of Classification Search
USPC ..... 439/157, 464–467; 174/50
See application file for complete search history.

(56) References Cited

U.S. PATENT DOCUMENTS

| | | | | | |
|---|---|---|---|---|---|
| 3,936,129 | A * | 2/1976 | Guy | 439/464 |
| 4,195,899 | A * | 4/1980 | Radloff et al. | 439/468 |
| 4,408,819 | A * | 10/1983 | Guelden | 439/638 |
| 5,315,062 | A * | 5/1994 | Hoshino | 439/446 |
| 5,564,953 | A * | 10/1996 | Endo et al. | 439/701 |
| 5,688,144 | A * | 11/1997 | Kosuge | 439/596 |
| 5,908,327 | A * | 6/1999 | Tsuji et al. | 439/470 |
| 5,967,830 | A * | 10/1999 | Tsuji | 439/470 |
| 6,095,852 | A * | 8/2000 | Gregory, II | 439/540.1 |
| 6,139,355 | A * | 10/2000 | Puerner | 439/473 |
| 6,155,884 | A * | 12/2000 | Sugiyama | 439/701 |
| 6,203,362 | B1 * | 3/2001 | Tsuji | 439/470 |
| 6,341,968 | B1 * | 1/2002 | Grant | 439/157 |
| 6,358,101 | B1 * | 3/2002 | Noro et al. | 439/752 |
| 6,461,177 | B1 * | 10/2002 | Saka et al. | 439/157 |
| 6,540,547 | B2 * | 4/2003 | Zweigle | 439/468 |
| 6,817,888 | B2 * | 11/2004 | Kozono et al. | 439/468 |
| 6,824,420 | B2 * | 11/2004 | Ushiro et al. | 439/455 |

(Continued)

FOREIGN PATENT DOCUMENTS

| | | | |
|---|---|---|---|
| EP | 1032085 | A2 | 8/2000 |
| EP | 2001089 | A2 | 12/2008 |

(Continued)

OTHER PUBLICATIONS

GB Search Report dated Nov. 24, 2011 issued by UK Intellectual Property Office for Application No. GB1112814.7, 3 pages.

(Continued)

*Primary Examiner* — Briggitte R Hammond
*Assistant Examiner* — Vladimir Imas
(74) *Attorney, Agent, or Firm* — Barley Snyder

(57) ABSTRACT

A wire cover has a cover body, a wire routing passageway and a hood. The cover body includes a plurality of wire receiving passageways positioned in one direction. The wire routing passageway is directed into an inside of the cover body. The hood protrudes from a circumference of the wire routing passageway and controls a leading direction out of the wire routing passageway wherein the hood has a different thicknesses between a base on a side of the cover body and a tip on another side of the cover body.

7 Claims, 5 Drawing Sheets

U.S. PATENT DOCUMENTS

| | | | | |
|---|---|---|---|---|
| 6,962,504 | B2 * | 11/2005 | Fukui et al. | 439/466 |
| 7,021,959 | B2 * | 4/2006 | Tsuji et al. | 439/470 |
| 7,128,601 | B2 * | 10/2006 | Suemitsu et al. | 439/521 |
| 7,559,778 | B2 * | 7/2009 | Pittenger et al. | 439/157 |
| 7,922,504 | B2 * | 4/2011 | Sakamaki et al. | 439/157 |
| 7,931,483 | B2 * | 4/2011 | Komiyama et al. | 439/157 |
| 7,938,655 | B2 * | 5/2011 | Komiyama et al. | 439/157 |
| 7,959,452 | B2 * | 6/2011 | Komiyama | 439/157 |
| 8,007,298 | B2 * | 8/2011 | Komiyama et al. | 439/157 |
| 8,043,111 | B2 * | 10/2011 | Takahashi et al. | 439/464 |
| 8,057,245 | B2 * | 11/2011 | Sakamaki et al. | 439/157 |
| 2005/0003698 | A1 * | 1/2005 | Hata | 439/470 |
| 2006/0009067 | A1 * | 1/2006 | Sakamaki et al. | 439/468 |
| 2008/0280467 | A1 | 11/2008 | Tsuji | |
| 2009/0221167 | A1 * | 9/2009 | Pittenger et al. | 439/157 |
| 2010/0178791 | A1 * | 7/2010 | Komiyama et al. | 439/347 |
| 2012/0028486 | A1 * | 2/2012 | Suemitsu et al. | 439/157 |

FOREIGN PATENT DOCUMENTS

| | | | |
|---|---|---|---|
| GB | 2077522 | A | 12/1981 |
| GB | 2461372 | A | 1/2010 |
| JP | 2010-92888 | | 4/2010 |

OTHER PUBLICATIONS

French Search Report, dated May 15, 2012, 6 pages.

* cited by examiner

WIRE COVER AND ELECTRICAL CONNECTOR

CROSS-REFERENCE TO RELATED APPLICATIONS

This application claims the benefit of the filing date under 35 U.S.C. §119(a)-d of Japanese Patent Application No.: 2010-169550, filed Jul. 28, 2011.

FIELD OF THE INVENTION

The invention relates to a wire cover that covers a plurality of wires, and an electrical connector using the wire cover.

BACKGROUND

In recent years, electrical connectors used in the field of automobiles have an increasing number of terminals. In an electrical connector having multiple terminals, multiple wires according to the number of terminals are positioned into a housing of the electrical connector.

The multiple wires are positioned into the housing through a wire receiving passageway formed in the housing, and a terminal positioned at an end of each wire is secured to a terminal receiving passageway formed in the housing.

There is also a connector such that multiple wires are placed along a hood portion formed in a housing, and the hood portion and the multiple wires are secured by a securing member such as a securing band or a cable tie (for example, see Japanese Patent Laid-Open No. 2010-92888). In such a structure, the multiple wires can be bound easily and neatly by securing the multiple wires with the securing band or the like.

However, in the structure in which the multiple wires are tied to the hood portion formed in the housing, a force applied to the hood portion may deform or damage the hood portion. This problem is particularly problematic for an electrical connector connected to a control unit for an automobile. The control unit for an automobile is installed in a limited space in a vehicle. Thus, in an assembling step of the automobile, with the electrical connector being connected to the control unit, an operator may hold the wires in his/her hand and route the wires to house the wires in a predetermined position. At this time, a large force is applied to the hood portion via the wires, which may deform or damage the hood portion.

SUMMARY

The invention is achieved in view of such technical problems, and has an object, among others, to provide a wire cover and an electrical connector that can prevent deformation or damage of the hood portion.

A wire cover has a cover body, a wire routing passageway and a hood. The cover body includes a plurality of wire receiving passageways positioned in one direction. The wire routing passageway is directed into an inside of the cover body. The hood protrudes from a circumference of the wire routing passageway and controls a leading direction out of the wire routing passageway wherein the hood has a different thicknesses between a base on a side of the cover body and a tip on another side of the cover body.

DETAILED DESCRIPTION OF THE EMBODIMENT(S)

Now, the present invention will be described in detail based on an embodiment shown in the accompanying drawings.

Figure 1:
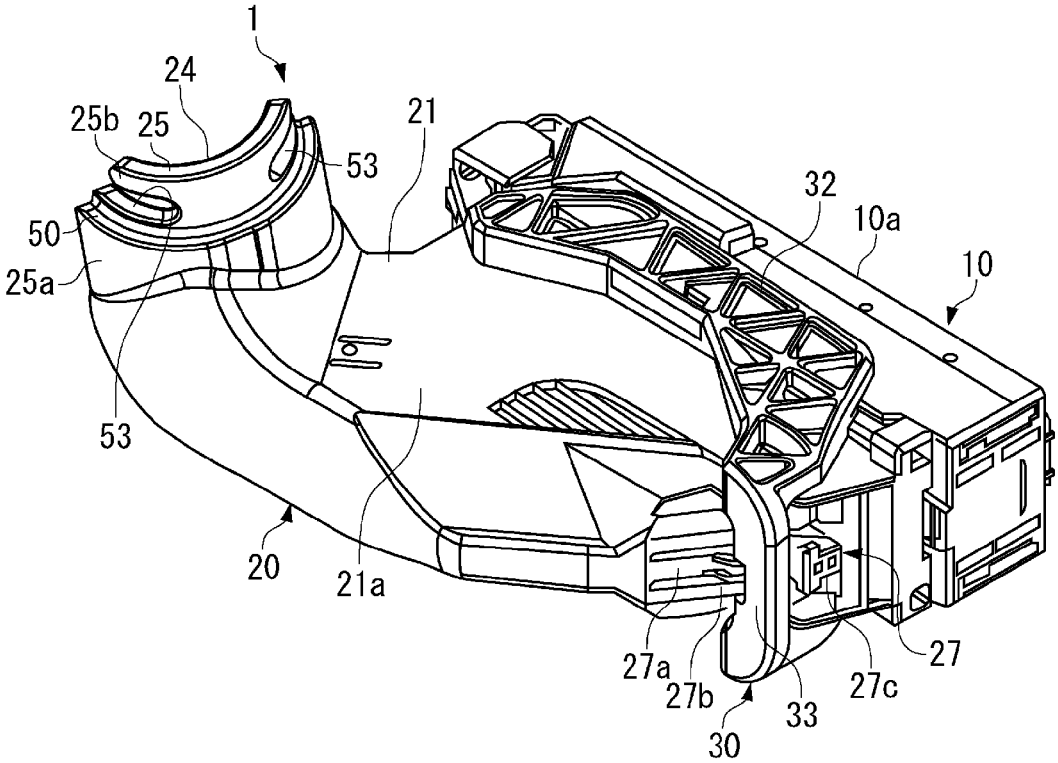
FIG. 1 is a perspective view of a lever connector according to an embodiment.
Figure 2:
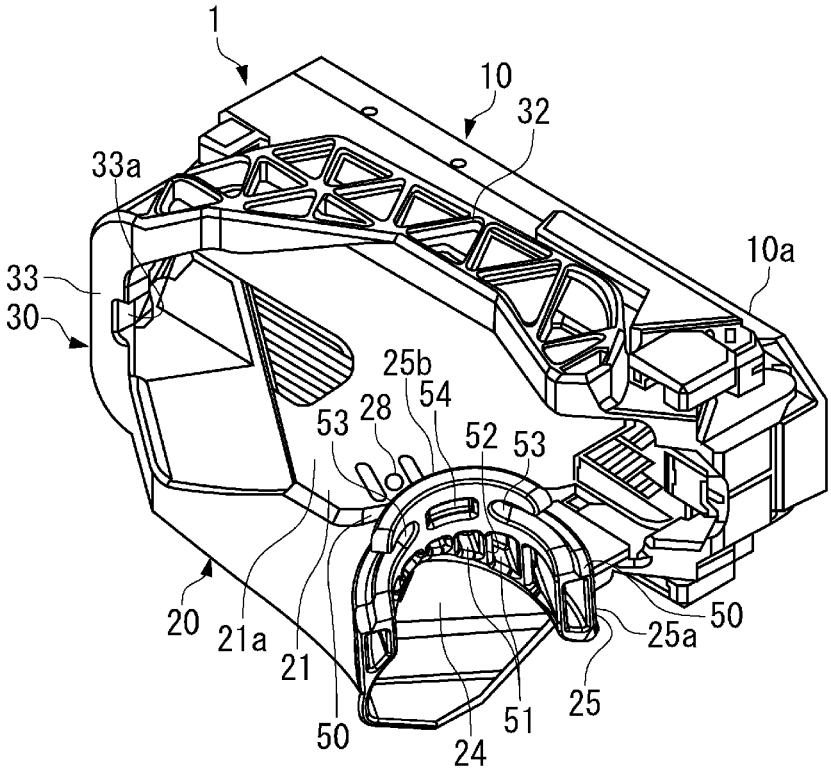
FIG. 2 is a perspective view of the lever connector seen from an angle different from that in FIG. 1.
Figure 3:
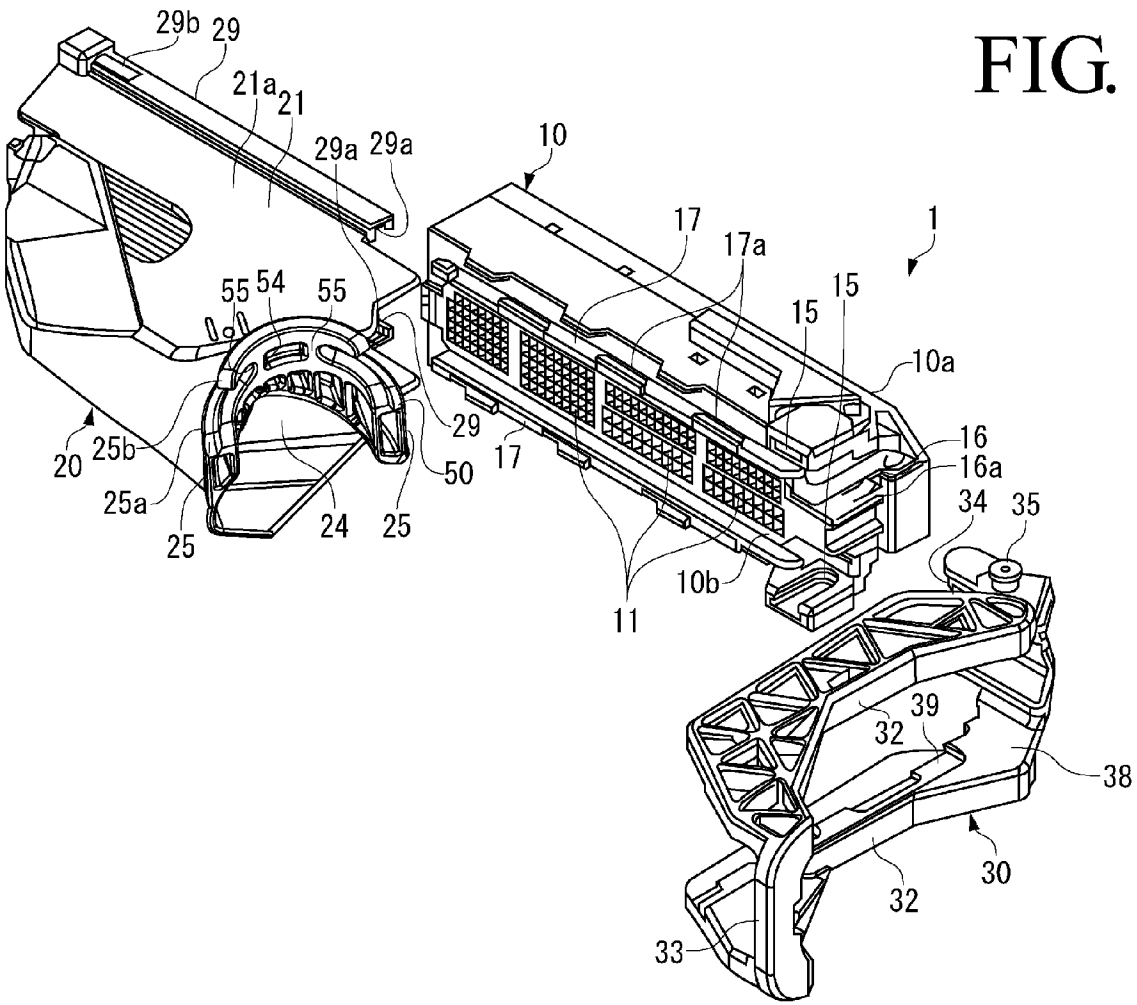
FIG. 3 is an exploded perspective view of the lever connector.

As shown in FIGS. 1 to 3, a lever connector 1 includes a housing 10 that receives a plurality of terminals (not shown), a wire cover 20 mounted to a side of a back surface 10*b* (see FIG. 3) of the housing 10, and a lever 30 mounted to the housing 10.

In the embodiment shown, the housing 10 extends in one direction along a front surface 10*a* facing a connection object of the lever connector 1. In the housing 10, a plurality of terminal receiving passageways 11 are formed in one direction and in a plurality of columns passing through the housing 10 in a direction connecting the front surface 10*a* and the back surface 10*b*.

At one end of the housing 10, a pair of lever connectors 16 are provided that connect with a shaft portion 34 of a lever 30, which is described later. Along a rear of each lever connector 16 of the housing 10, a latch arm 16*a* is positioned for locking the shaft portion 34 of the lever 30 fitted to each lever connector 16. Securing pieces 17 for securing the wire cover 20 are positioned along vertically opposite ends of the back surface of the housing 10. Each securing piece 17 is provided to protrude from the back surface 10*b*. A plurality of securing protrusions 17*a* protruding outward are positioned near each securing piece 17.

A lever connector 15 is positioned at one end of the housing 10, to which a slider moving shaft 35 described later of the lever 30 is fitted.

The lever 30 includes a pair of side plates 32 and a connecting portion 33 connecting other ends of the side plates 32. The lever has a U-shape in the embodiment shown.

The slider moving shaft 35 that is fitted to the lever connector 15 is formed to protrude outward and positioned on an outer surface at one end of each of the side plates 32. The shaft portion 34 that is fitted the lever connector 16 of the housing 10 is formed to protrude inward and positioned on an inner surface at one end of each side plate 32. The shaft portion 34 is fitted to the lever connector 16, and thus the lever 30 pivots around the shaft portion 34 with respect to the housing 10. When the lever 30 is pivoted, the slider moving shaft 35 moves along a guide groove formed in a counterpart connector as a connection object to assist fitting between the lever connector 1 and the corresponding connector.

Further, a flat portion 38 is positioned along the inner surface at one end of the side plate 32, which is brought into contact with the wire cover 20 when the lever 30 is removed from the housing 10. Also a notch portion 39 extending in a lateral direction is positioned along the inner surface of the side plate 32.

A recess 33*a* is positioned along the connecting portion 33, in which a locking piece 27*b* of a lock 27 of the wire cover 20 is locked, which will be described in more detail below.

The wire cover 20 has a cover body 21 that covers wires (not shown) connected to the terminals that have are received in the housing 10. The cover body 21 is closed except for a side facing the housing 10 and a wire routing passageway 24 described later.

As shown in FIG. 1, a lock 27 is positioned on a back surface of the cover body 21. The lock 27 secures the lever 30 when the lever 30 is tilted. The lock 27 includes a cantilevered leaf spring 27*a*, the locking piece 27*b*, and an unlocking protrusion 27*c* that is positioned on an outer surface of the leaf spring 27*a*. The leaf spring 27*a* extends toward a connecting portion 33 of the tilted lever 30 in the embodiment shown. The locking piece 27*b* is locks in the recess 33*a* in the connecting portion 33 of the tilted lever 30. When the unlocking protrusion 27*c* is pressed away from the connecting portion 33, the leaf spring 27*a* is elastically deformed that disengages the locking piece 27*b* from the recess 33*a*.

A locking protrusion 28 for locking the raised lever 30 is positioned on the cover body 21. Each locking protrusion 28 locks with a notch portion 39 formed along each side plate 32 of the raised lever 30.

Securing portions 29 for securing the wire cover 20 to the housing 10 are positioned on a side facing the housing 10 of the cover body 21. Each securing portion 29 has a securing groove portion 29*a* into which the securing protrusion 17*a* of the housing 10 is inserted. A latch arm 29*b* is positioned at the other end of each securing portion 29. A protrusion (not shown) that locks to a side surface of the securing protrusion 17*a* of the housing 10 is positioned on each latch arm 29*b*.

Figure 4A:
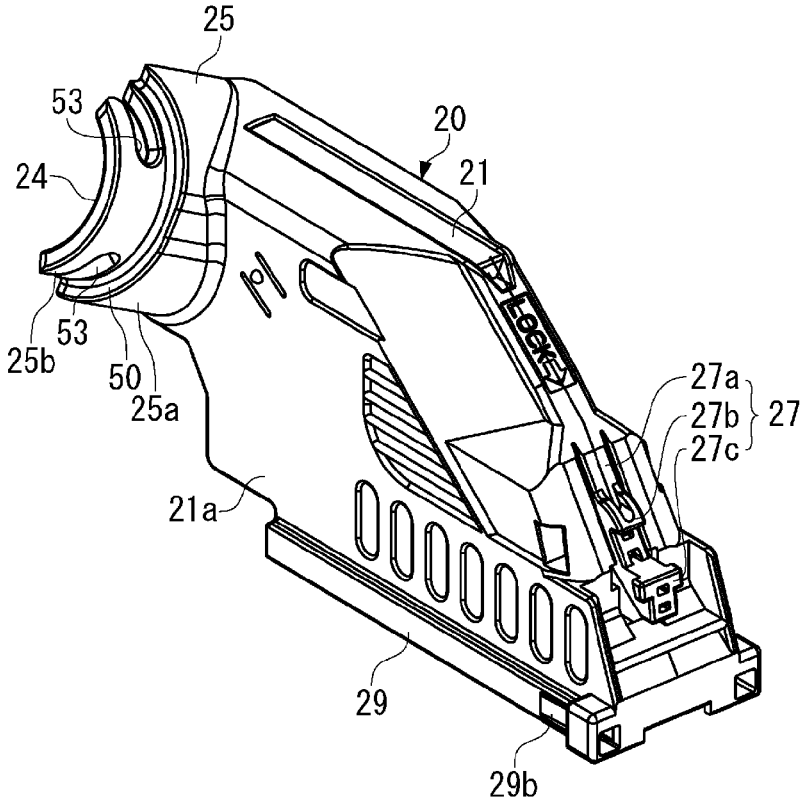
FIG. 4A is a perspective view of a wire cover.
Figure 4B:
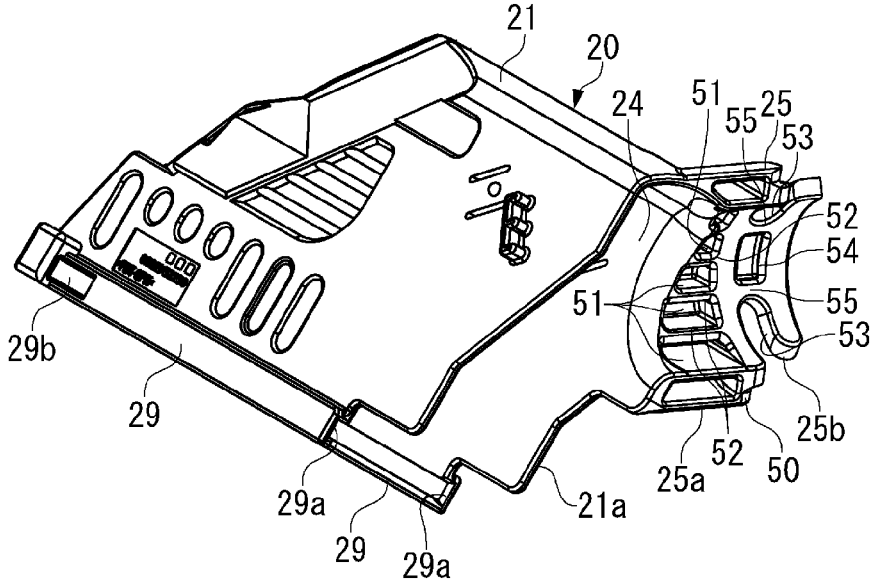
FIG. 4B is a perspective view of the wire cover seen from an angle different from that in FIG. 4A.
Figure 5:
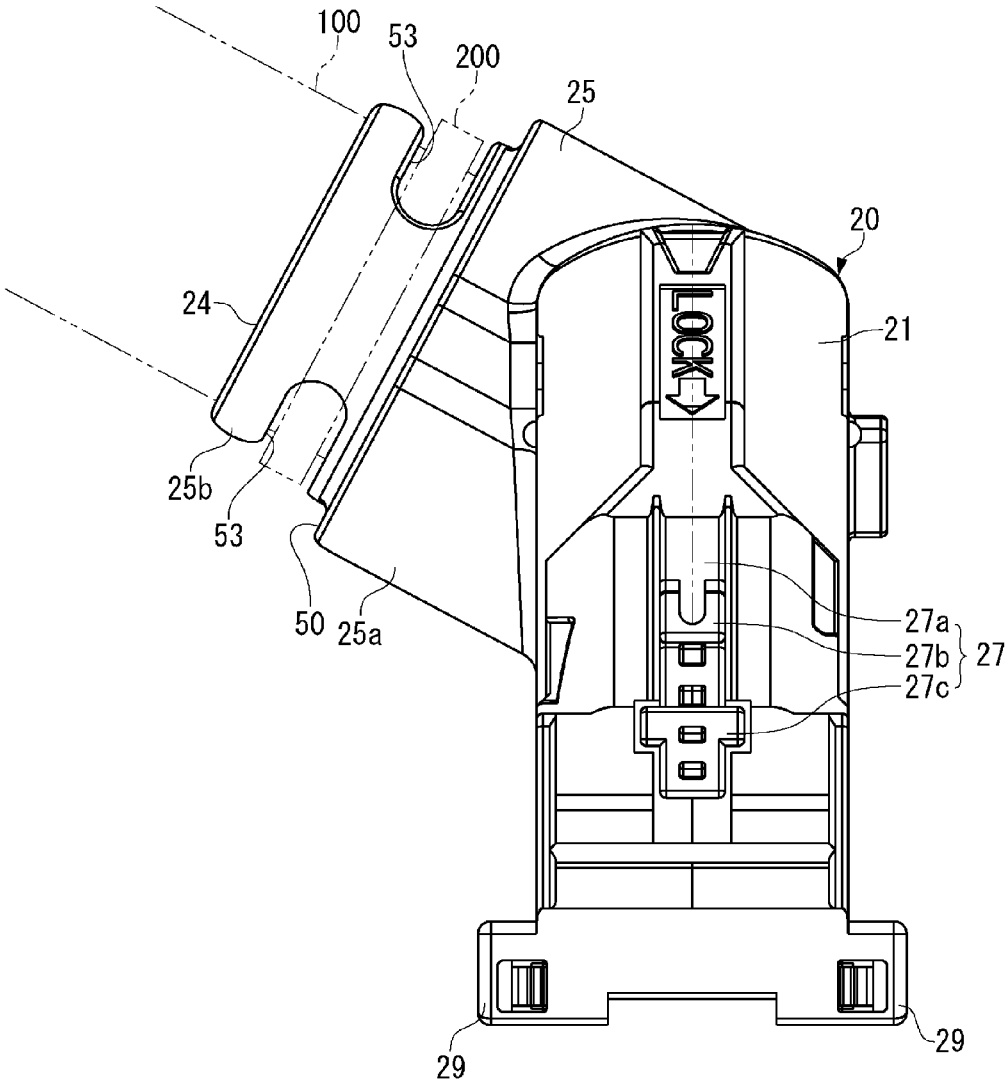
FIG. 5 is a side view of the wire cover.

As shown in FIGS. 4A, 4B and 5, a wire routing passageway 24 is positioned at one end of the cover body 21, through which the wires connected to the terminals, received in the housing 10, are led out in a secured state. A hood portion 25 is positioned around the wire routing passageway 24. The hood portion 25 connects along a front surface side and a back surface side of the wire cover 20, and protrudes in an inclined direction with respect to a surface including a longitudinal direction of the housing 10.

The hood portion 25 diagonally controls a draw-out direction of the wires from the wire routing passageway 24. The inclination angle and direction of the hood portion 25 are not limited to those shown, but may be other angles and directions.

The hood portion 25 includes an arcuate section. The hood portion 25 in the embodiment shown has different thicknesses between a base 25*a* on a side of the cover body 21 and a tip 25*b* on a side away from the cover body 21. The base 25*a* is thicker than the tip 25*b*. Inner peripheral surfaces of the base 25*a* and the tip 25*b* are smoothly continuous. Meanwhile, a step 50 is formed between outer peripheral surfaces of the base 25*a* and the tip 25*b* because of the different thicknesses.

A plurality of recesses 51 are positioned in an inner peripheral surface of the base 25*a*. The recesses 51 are arranged continuously in a curving direction (circumferential direction) of the hood portion 25, and thus a rib 52 continuous in an extending direction of the hood portion 25 is positioned between the recesses 51 and 51 adjacent to each other.

In a tip 25*b* of the hood portion 25, notches 53 and 53 extending in a circumferential direction are positioned at opposite ends. A recess 54 is formed between the notches 53 and 53, in an inner peripheral surface of the tip 25*b* of the hood portion 25. Between the recess 54 and each of the notches 53 and 53 on opposite sides thereof, a rib 55 continuous in the extending direction of the hood portion 25 is positioned.

In the lever connector 1, a cable 100 with a plurality of wires being tied is inserted through and led out from the wire routing passageway 24. The cable 100 is separated into the wires within an inner space of the wire cover 20, and a terminal provided at a tip of each wire is inserted and fitted into the terminal receiving passageway 11 of the housing 10.

The cable 100 is led out from the wire routing passageway 24 to an exterior of the lever connector 1. The cable 100 is positioned along the inner peripheral surface of the hood portion 25 and thus controlled in the lead-out direction. Thus, the cable 100 is diagonally led out according to the inclination direction of the hood portion 25 in the embodiment shown.

The cable 100 is positioned along the hood portion 25, and a strap-like securing member 200, such as a securing band or a cable tie, is wound there around to tie and secure the hood portion 25 and the cable 100.

In order to fit the lever connector 1 to a counterpart connector to each other, the lever 30 is first raised. The raised lever 30 is locked by the locking protrusion 28 on the cover body 21 of the wire cover 20 being locked to a side surface of the notch portion 39 in each side plate 32 of the lever 30. In this state, the lever connector 1 and the counterpart connector are temporarily fitted to each other.

Next, the locking protrusion 28 on the cover body 21 of the wire cover 20 is unlocked from the lever 30, and the raised lever 30 is pivoted in a tilting direction. When the lever 30 is tilted, the slider moving shaft 35 moves along the guide groove positioned in the counterpart connector to assist fitting between the lever connector 1 and the counterpart connector, and the plurality of terminals received in the housing 10 of the lever connector 1 are fitted to the terminals received in the counterpart connector.

When the lever 30 is pivoted and tilted, the lever connector 1 fits with the counterpart connector and connection is completed. The locking piece 27*b* locks into in the recess 33*a* of the connecting portion 33, preventing the tilted lever 30 from pivoting.

In the lever connector 1 as described above, the hood portion 25 of the wire cover 20 is formed to protrude diagonally. Thus, the cable 100 is led out diagonally from the exit in the wire cover 20 according to the inclination direction of the hood portion 25, and the cable 100 can be optimally routed according to a space therearound to increase flexibility of routing of the cable 100 within a limited space. This design can prevent the cable 100 from being bent which may apply a load to the cable 100. In addition, this design provides high durability of the cable 100.

Further, when a lever connector 1 with a different depicted direction (angle) of a cable 100 is configured, only a wire cover 20 may be changed and other components such as a housing 10 need not be changed. This allows the cable 100 to be drawn out at various angles at low cost.

At this time, the hood portion 25 has different thicknesses between the base 25*a* on the side of the cover body 21 and the tip 25*b* on the side away from the cover body 21, and the base 25*a* is thicker than the tip 25*b*. Thus, even if a force is applied from the cable 100 to the hood portion 25 when the operator routes the cable 100 during assembly, the base 25*a* particularly has a large thickness, thereby preventing the hood portion 25 from being broken or damaged.

Further, in the inner peripheral surface of the base 25*a*, the plurality of recesses 51 are formed, thereby reducing use of a material required for forming the wire cover 20, and also reducing weight of the wire cover 20. Further, the recesses 51 are continuously arranged around the circumference of the hood portion 25, and thus the rib 52 is formed between the recesses 51 and 51 adjacent to each other. Thus, when the cable 100 is routed and a force is applied to the hood portion 25, the force is transferred from the tip 25*b* side to the base 25*a* side through the rib 52. This allows effective treatment and dissipation of the force applied to the hood portion 25.

In the embodiment shown, the configuration of the lever connector 1 has been described, and configurations other than the hood portion 25 that is the gist of the claimed invention may be changed.

In this embodiment, the lever connector 1 that can be easily mounted and removed by pivoting the lever 30 is taken as an example. However, not limited to the lever connector, the present invention may be similarly applied to a general connector or the like.

The hood portion is advantageously formed so that the base is thicker than the tip for reinforcement.

Further, the configurations described in the embodiment may be chosen or changed to other configurations without departing from the gist of the present invention.

What is claimed is:

1. An electrical connector comprising:

a housing in which a plurality of terminal receiving openings are arranged in one direction; and a wire cover mounted to a back surface side of the housing, the wire cover comprising a cover body, a plurality of recesses positioned along an inner peripheral surface of a base having a first thickness on a side of the cover body, ribs disposed between the recesses, and another recess positioned along an inner peripheral surface of a tip having a different thickness; and a U-shaped lever having a pair of side plates and a connecting portion that connects the side plates to each other, wherein the lever is mounted pivotably with respect to the housing in such that the lever crosses the back surface side of the wire cover and the wire cover is held in a thickness direction between the side plates.

2. The electrical connector of claim 1, wherein the wire cover further comprises a wire routing passageway directed into an inside of the cover body.

3. The electrical connector of claim 2, wherein the wire cover further comprises a hood protruding from a circumference of the wire routing passageway.

4. The electrical connector of claim 3, wherein the hood protrudes in a direction substantially perpendicular to a direction extending perpendicular to a surface of the of a front surface and a back surface of the cover body.

5. The electrical connector of claim 3, wherein the hood is formed to have an arcuate section along an outer peripheral surface.

6. The electrical connector of claim 5, wherein the hood has a recess formed in an inner peripheral surface of the tip.

7. The electrical connector of claim 1, wherein the base is thicker than the tip.

* * * * *